United States Patent [19]

Ahlers

[11] 4,388,954

[45] Jun. 21, 1983

[54] ROTATING SINGLE OR MULTI-CHAMBER COUNTERPRESSURE FILLING MACHINES

[75] Inventor: Egon Ahlers, Neu-Bamberg, Fed. Rep. of Germany

[73] Assignee: Seitz-Werke GmbH, Bad Kreuznach, Fed. Rep. of Germany

[21] Appl. No.: 264,023

[22] Filed: May 15, 1981

[30] Foreign Application Priority Data

May 21, 1980 [DE] Fed. Rep. of Germany ..... 3019381

[51] Int. Cl.[3] ..... B65B 3/04

[52] U.S. Cl. ..... 141/39; 141/140; 141/372

[58] Field of Search ..... 141/6, 39, 140–150, 141/156–162, 172, 181, 369–372

[56] References Cited

U.S. PATENT DOCUMENTS 3,841,363 10/1974 Stigler ..... 141/150 X

FOREIGN PATENT DOCUMENTS 2713562 10/1978 Fed. Rep. of Germany ..... 141/372

*Primary Examiner*—Frederick R. Schmidt

*Attorney, Agent, or Firm*—Becker & Becker, Inc.

[57] ABSTRACT

A rotating single or multi-chamber counterpressure filling machine is provided and has filling elements respectively provided with a controlled pressurized gas valve arrangement having a valve- and control-unit, and with a centering device comprising a centering tulip on guided rods which are movable up and down, said centering device including a holder to fix the centering device in an upper position, and a releasor for releasing this holder. The holder and releasor are in the form of a controllable arresting device for arresting and releasing the centering device; the arresting device engages, or meshes in, at least one of the rods of the centering device.

5 Claims, 13 Drawing Figures

ROTATING SINGLE OR MULTI-CHAMBER COUNTERPRESSURE FILLING MACHINES

The present invention relates to rotating single and multi-chamber counterpressure filling machines. The filling elements thereof are each provided with a controlled pressurized gas valve arrangement having a valve- and control-unit, and with a centering device comprising a centering tulip on guided rods which are movable up and down, said centering device including holding means for fixing the centering device in an upper position, and means for releasing the holding means.

German Offenlegungsschrift No. 27 13 562 discloses a rotating counterpressure filling machine of this type according to which the holding means for fixing the centering device in an upper position are formed by magnets respectively located on a filling element. Considerable forces are necessary to release the centering device from the magnets, i.e., to bring about the downward movement of the centering device by means of the releasing means which are common to all the filling elements, and these forces have a disadvantageous effect upon the journalling of the rods. Accordingly, with the known filling machine, the holding means of the centering tulip in the centering device tends to tilt and stick. With this known filling machine, the holding means formed by the magnets is only effective when the holding of the centering tulip of the container to be filled is lifted during the lifting thereof into the filling position until reaching the highest position. If a filling location is not occupied with the known machine, then the holding means formed by a magnet is effective and the holding means of the centering tulip remains down, so that the plate of the lifting device for the containers to be filled in a disadvantageous situation strikes against the underside of the centering tulip and can contaminate the same with germs which are harmful to the material to be dispensed. With the known filling machine, falling of the centering device released from the holding means onto the withdrawn filled container can only be avoided when an additional equalizing element is provided for the height differences of the containers to be filled. This dropping of the centering device onto the filled container is especially disadvantageous when liquid which contains dissolved gas, for example carbon dioxide containing beverages, is dispensed, because the contents are disturbed by the impact applied to the filled container.

By comparison, it is an object of the present invention, with rotating counterpressure filling machines of the foregoing type, to substantially improve the holding and releasing means provided for the centering device in such a way that each centering device is individually controllable both for holding and also for releasing, whereby the controlled holding means engages the centering device, and likewise in a controlled manner again releases the centering device without stressing by lateral forces, and without requiring auxiliary means for preventing dropping of the centering device onto the filled containers during withdrawal of the filled container.

This object, and other objects and advantages of the present invention, will appear more clearly from the following specification in connection with the accompanying drawings, in which.

Figure 4:
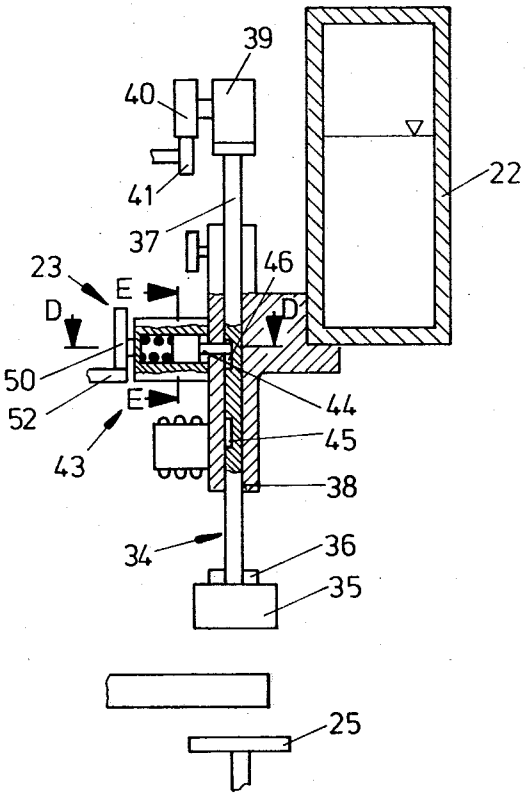
FIG. 4 is a partial section taken along line C—C of FIG. 2.
Figure 3:
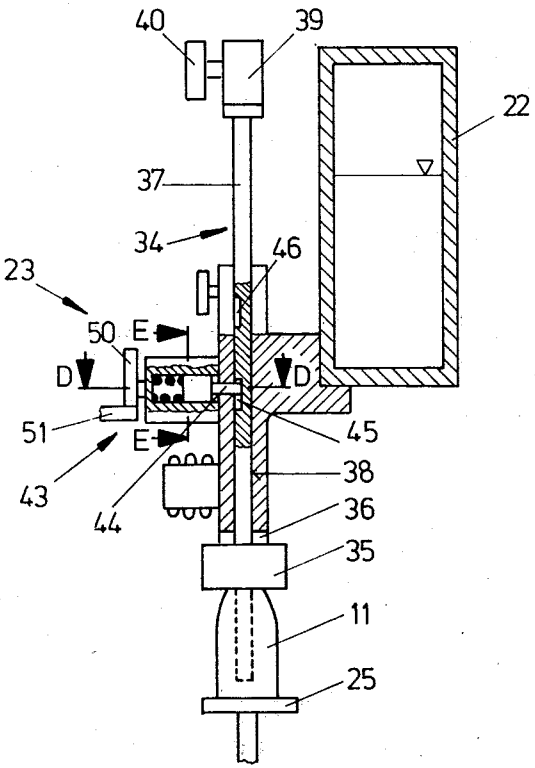
FIG. 3 is a partial section taken along line B—B of FIG. 2.
Figure 9:
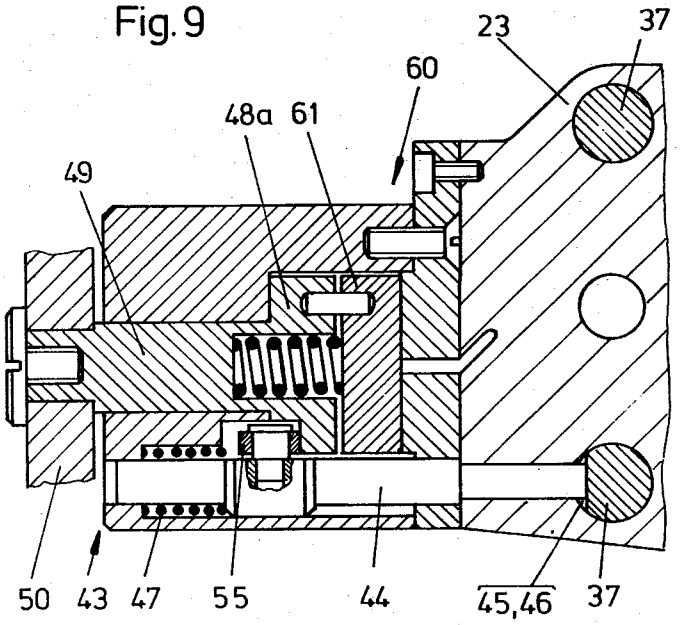
Figure 5:
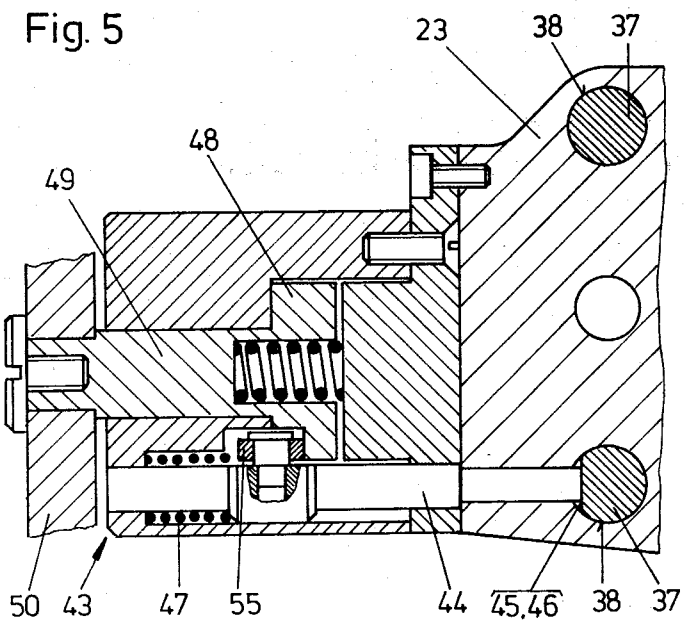
FIG. 5 is an enlarged illustration taken in section along lines D—D of FIGS. 3 and 4.
Figure 6B:
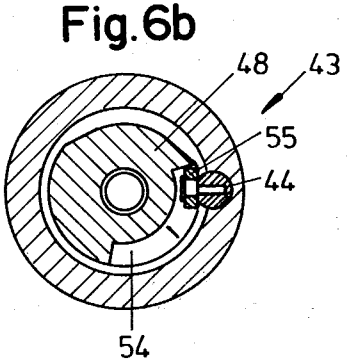
Figure 6A:
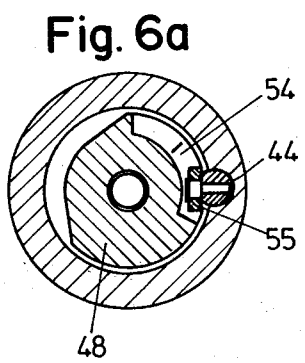
Figure 10C:
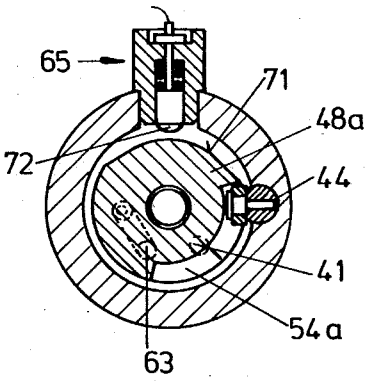
Figure 10B:
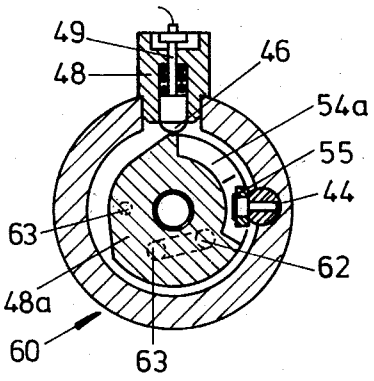
Figure 10A:
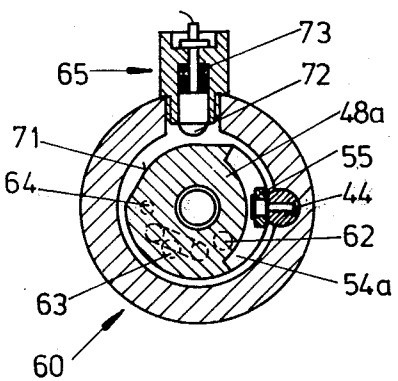
Figure 7:
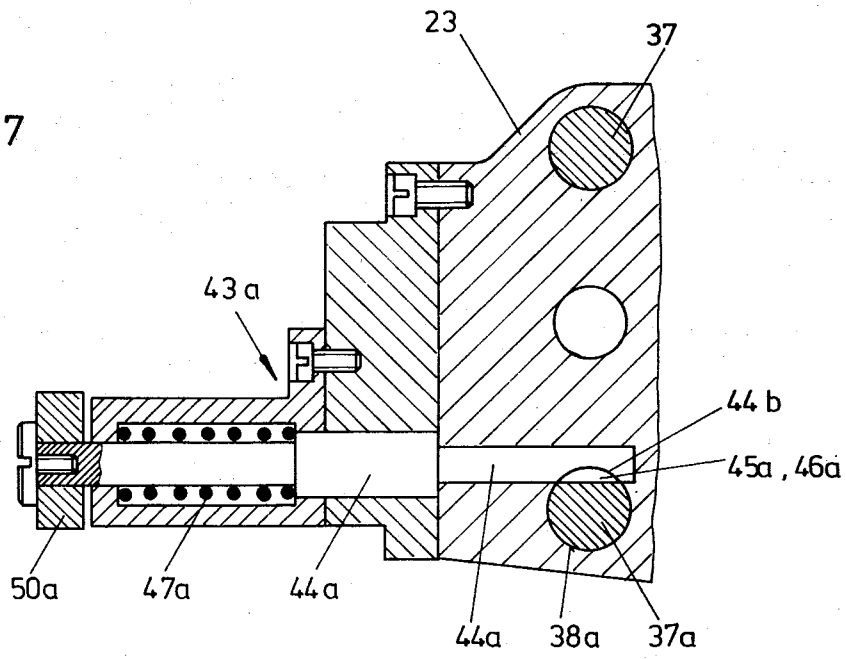
Figure 8:
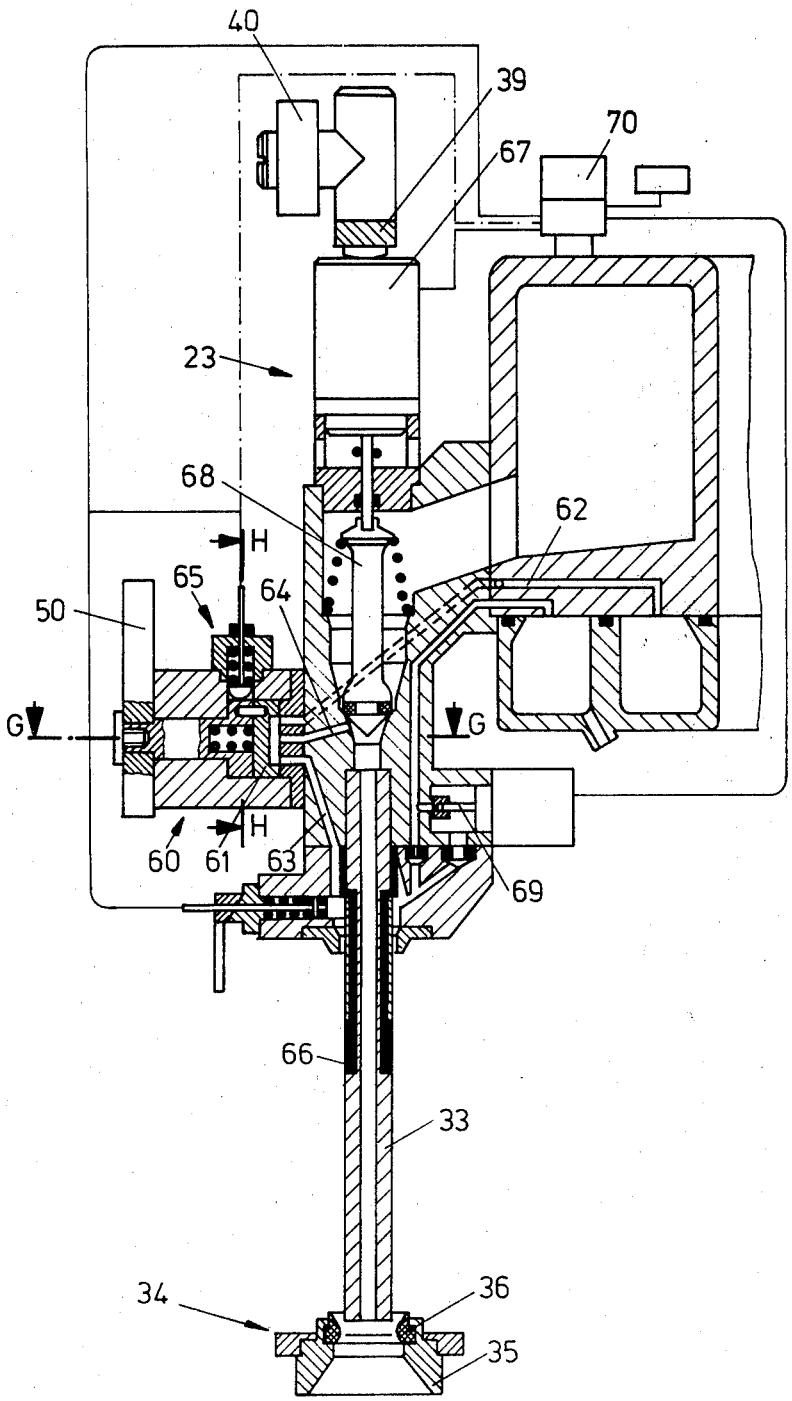

FIGS. 6*a* and 6*b* are sections taken along lines E—E in FIGS. 3 and 4 respectively;

FIG. 7 is a somewhat modified embodiment of the arresting device illustrated in a view corresponding to that of FIG. 5;

FIG. 8 shows a counterpressure filling machine having features in accordance with the present invention with a modified filling element, the arresting device of which, for the centering device, is combined with a valve and control unit;

FIG. 9 is an enlarged sectional illustration of the combined arresting device with valve and control unit taken along a plane represented by line G—G of FIG. 8; and FIGS. 10*a*, 10*b*, 10*c* show different operating positions corresponding to the line H—H in FIG. 8.

The counterpressure filling machine of the present invention is characterized primarily in that each filling element is provided with a controllable arresting device, as holding and releasing means, for arresting and releasing the centering device; the arresting device engages, or meshes in, at least one of the rods of the centering device.

In this way, a reliable arresting and releasing of the centering device, which is movable up and down, is made possible with accurate control without the necessity of considerable forces for arresting, especially for releasing, the centering device. In particular, the inception of the downward movement of the centering device upon release occurs practically smoothly and free of impact. Above all, the controlled arresting device offers the possibility or providing an arresting of the centering device in the lifted or partially lifted position for the situation that one of the filling elements of the filling machine remains unoccupied. Additionally, no auxiliary means are required for preventing dropping of the centering device onto the filled container.

According to an advantageous embodiment of the invention, at least one of the rods of the centering device is provided with at least one arresting recess, and the arresting device has an axially shiftably journalled arresting bolt which is controllable in and out of the arresting recess. According to another embodiment of the present invention, it is also possible to provide at least one of the rods of the centering device with at least one arresting recess, with the arresting device having a pivotably journalled arresting bolt which, with a lateral recess, is controllable in and out of the arresting recess of the rod.

Since with the provided rotating counterpressure filling machines the up and down movement of the centering device is synchronized with the control of the pressurized gas valve arrangement, in accordance with the invention it can be especially advantageous to form a structural unit comprising the arresting device with the valve and control unit of the pressurized gas valve arrangement with the arresting device being controllable in common with the pressurized gas valve arrangement. For this purpose, for example, the valve and control unit for the pressurized gas control can be provided with a valve disc having openings and connecting conduits; the valve disc is adjustable, by rotation into desired operating positions, by means of a surface containing the openings from the gas-guiding conduits. At least one control cam for actuating the arresting bolt is provided on the peripheral region and/or on the back of the valve disc and/or an essentially disc-shaped valve-disc carrier.

With this unification of the control cam with the valve disc or the valve disc carrier, it is recommended to mount the arresting bolt in the valve and control unit in such a way that it is axially retractable against spring force axially parallel to the valve disc, and to arrange the cam surface controlling the arresting bolt upon the back side of the valve disc or of the valve-disc carrier. Consequently, every mutual disturbance of the valve function and the function of the control cam is precluded with certainty. Furthermore, this arrangement makes it possible to arrange still further control functions on the valve disc or on the valve disc carrier. For example, the periphery of the valve disc or of the valve disc carrier can be embodied as a cam for actuating an additional control element, for example an electrical control switch.

With such inventive rotating counterpressure filling machines, the possible vertical movement path of the centering device is so great that with a lowered centering device and in the absence of a container, the bottle plate on the way to the upper position could strike against the centering tulip. It is therefore recommended, in order to avoid such a possibility, to provide a simple additional arresting control in order to keep the centering device in an at least partially lifted position. This simple additional arresting device can include the arrangement of devices on the machine frame for lifting the centering device for introducing the container to be filled; and at least one of the rods of the centering device is embodied with at least one further arresting recess above the arresting recess which is effective for the upper position of the centering device. It is further possible to arrange an additional control element, which is periodically brought into effective and ineffective condition in the inlet region on the machine frame. This additional control element is connected by means of an additional control device with an element which monitors the introduction of the containers to be filled. This additional control device brings the additional control element into an ineffective or inoperative condition upon entry of containers to be filled into the filling machine, and brings the additional control element into an effective condition when such a container is absent. This means that by means of this additional control the centering device, which is lifted prior to the introduction of the container to be filled, is kept in this lifted condition.

Figure 1:
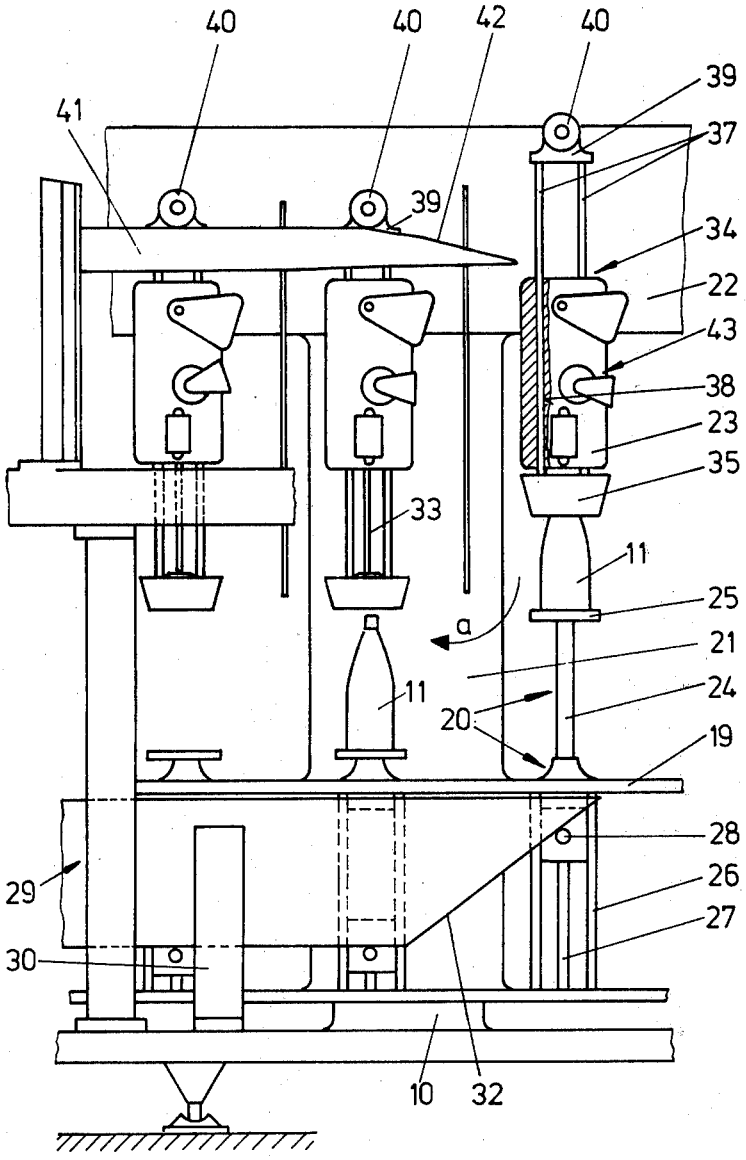
FIG. 1 is a partial side view of a counterpressure filling machine having features in accordance with the present invention, and is of the region indicated by the arrows A—A of FIG. 2.
Figure 2:
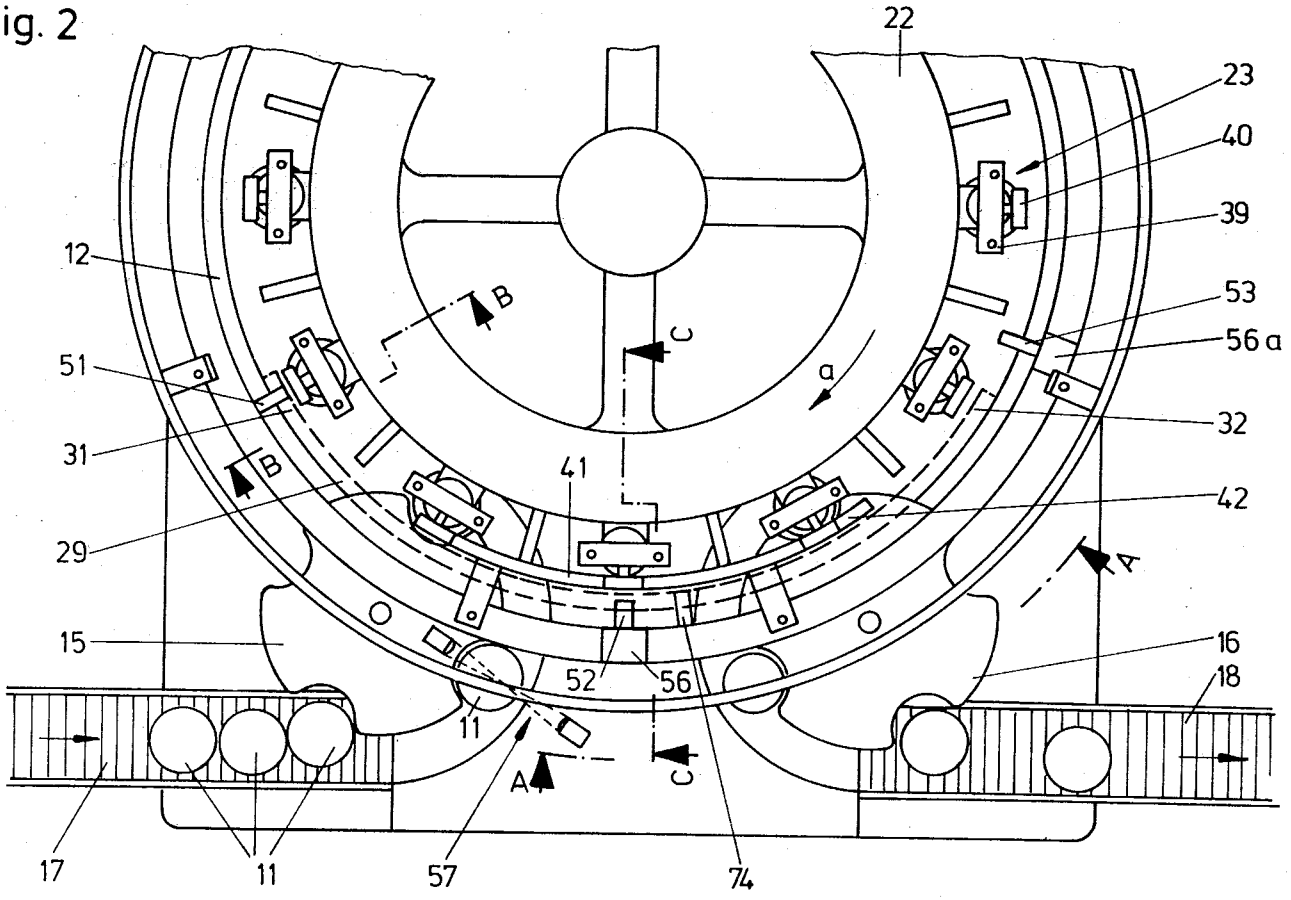
FIG. 2 is a partial plan view of a counterpressure filling machine according to FIG. 1.

Referring now to the drawings in detail, in the embodiment of FIGS. 1–6, the filling machine includes a stationary and a rotating or circulating part. The stationary part essentially includes a column 10 along which the rotating part is rotatably installed in the direction of the arrow a. Also associated with the stationary part of the machine, as shown in FIG. 2, are the introduction and discharge or eject sprockets, turnstiles, or star wheels 15, 16, each having a feeding or discharging conveyor belt 17, 18 arranged before or thereafter respectively.

The rotating part of the machine essentially comprises the machine table 19 with several bottle carriers 20 installed thereon in such a way as to be liftable and capable of being lowered, and are arranged in a predetermined spacing; in addition, a filler tank 22 is connected with the table 19 by means of a central column 21. The periphery of the filler tank 22 supports several equidistantly spaced filling elements 23 which are located across from the bottle carriers 20. The bottle carriers 20 each comprise a vertical tube 24 which projects beyond the upper table level and have a bottle plate or disc 25 secured thereto. The opposite tube end telescopically glides within a table guide 26 upon a guide rod 27, and supports a roller 28. A control curve or cam 29 which cooperates with the rollers 28 is fastened by means of struts or supports 30 on a stationary part of the machine. The cam 29 extends from an introduction star 15 to the discharge star 16, and in the region of the star 15 has an upwardly extending section 31, and in the region of the discharge star 16 has a downwardly extending section 32.

The filling elements 23 are equipped in the illustrated example with suitably exchangeable filling tubes 33, and with a centering device which is movable up and down. This centering device 34 comprises a centering tulip 35 which is arranged below the filling element housing and has a rubber element 36 installed above the centering cone (FIGS. 3 and 8). The lower end of a rod guide-means formed of parallel rods 37 is fastened to the tulip 35. The vertical rods 37 extend in the bores 38 provided in the filling element housing. The upper ends of the rods 37 project beyond the housing and are connected by means of a bridge 39 which supports a control roller 40.

A further control curve or cam 41 is fastened to the machine frame 12. This cam 41 projects ahead of the discharge region of the machine into the circulating path of the control rollers 40, and has an upwardly leading section 42 arranged ahead of the discharge star 16, and a downwardly leading section in the region of the star 15.

A holding and releasing means in the form of an arresting device 43 is provided for each centering device 34. The arresting device 43 includes an arresting bolt 44 which is supported in such a way as to be axially shiftable. This arresting bolt 44 engages in the guide bore 38 of one of the rods 37 of the centering device 34. This guide rod 37 is provided with two arresting recesses 45 and 46, arranged axially spaced from each other, for cooperation with the inner end of the arresting bolt 44. As shown in FIG. 3, the lower arresting recess 45 of the rod 37 is located across from the inner end of the arresting bolt 44 when the centering device 34 has been lifted into the uppermost position by a bottle 11 to be filled and by the bottle plate 25. In this uppermost position, the rubber element 36 tightly engages against the housing of the filling element 23. FIG. 4 shows that the upper arresting recess 46 of the rod 37 is located across from the inner end of the arresting bolt 44 when the centering device 34 is located in an intermediate position in which the roller 40 runs along the horizontal path of the cam 41, which lifts the centering device 34 in the region of the discharge star 16 and the star 15. FIG. 4 shows a position with which the respective filling element 23 and the respective bottle plate 25 are located in the region between the stars 15 and 16.

The axial movement necessary for the control of the arresting bolt 44 is produced in the example of FIGS. 3–6 by means of a press spring 47 which presses the arresting bolt 44 axially in the direction of the rod 37, and by a rotatable control disc 48 which retracts the arresting bolt 44 from the rod 37. This control disc 48 is rotatably journalled in the housing of the arresting device 43 by a shaft 49, and is connected at the outer end with a control lever 50 which strikes or encounters control elements 51 or 52 or 53 or 74 installed at different levels on the machine frame 12. The control elements 51 and 52 illustrated in FIGS. 3 and 4 are arranged in such a way that they pivot the control lever 50 into a position in which the cam surface 54 (FIG. 6*a*), which is embodied as a depression or recess provided on the back of the control disc 48, is so adjusted that the follower roller 55 secured to the arresting bolt 44 is seated at the recessed location of the cam surface 54, so that the arresting bolt 44 is shifted or pushed by the action of the spring 47 into the arresting recesses 45 or 46 of the rod 37. In contrast, the control elements 53 and 74 illustrated in FIG. 2 are respectively embodied for the purpose of pivoting the control lever 50 of the arresting device 43 in such a way that the control disc 48 reaches the position illustrated in FIG. 6*b*, in which the follower roller 55 is seated on an elevated location of the cam path 54 and consequently retracts the arresting bolt 44 from the arresting recesses 45 or 46 of the rod 37 against the action of the spring 47.

As indicated in FIG. 2, the control element 51 is rigidly installed on the machine frame 12 (aside from the setting capability and adjustment capability) ahead of that region in which the pressurizing of the bottle to be filled is undertaken with gas, i.e., ahead of that region of the filling machine in which increased danger of breakage exists for the bottles to be filled. At this location the particular bottle to be filled is lifted into the filling position, and the centering device 34 is brought into the uppermost position, as shown in FIG. 3.

As shown in FIG. 2, the control element 52 is arranged between the star 16 and the star 15 on the machine frame 12. This control element 52 is connected with a control device 56, which in one control position keeps the element 52 in effective condition, and in the other control position keeps it in the ineffective condition. The control device 56 is connected to a light barrier 57 which determines whether a bottle 11 to be filled has been received by the star 15. When a bottle 11 transported by the star 15 passes the light barrier 57, the control device 56 places the control element 52 into the ineffective position. When it is in the operative position and a bottle 11 is not present, i.e. there is an empty space in the star, the control element 52 acts upon the control lever 50 in the same manner as does the control element 51.

The control element 53 is arranged essentially fixed or stationary on the machine frame 12, as shown in FIG. 2, and in particular at a location ahead of where the lower control rollers 28 run under the cam 29, i.e., before the bottle plate 25 is lowered. This control element 53 is likewise connected with a control device 56*a*, which in one control position keeps the element 53 in an effective condition, and in another control position keeps it in an ineffective condition. The effective condition or position is provided with an occupied filling element 23 (FIG. 3). The ineffective condition or position is assumed by the control element 53 when passing an unoccupied filling element 23, and is brought about by a control signal which is triggered by, for example, a switch, particularly a proximity switch, which is arranged in the circulating direction a ahead of the control element 53 at the level of the centering tulip 35 with the intermediate position of the centering device 34 illustrated in FIG. 4.

The control element 74 is essentially fixed or stationary, and is arranged in the circulating direction a ahead of the control element 52 on the machine frame 12 at the level of the control element 53. The element serves to cancel or eliminate the arresting of a centering device 34 located in an intermediate position according to FIG. 4 during the ineffective condition or position of the control element 53.

In normal operation, i.e. during entry of a bottle 11 into the star 15 and passing of the light barrier 57, the control element 52 is brought into the ineffective condition. The bottle 11 passes onto the corresponding bottle plate 25 and below a filling element 23, whereby the control roller 40 on the centering device 34 of this filling element runs off of the cam 41, and the centering device 34 with the centering tulip 35 lowers over the bottle 11 to be filled. During further circulation of the machine, the bottle plate 25 is lifted, so that the bottle 11, accompanied by lifting of the centering device 34, is lifted as far as to the underside of the filling element housing and is sealed off. The filling element 23 then moves past the control element 51, which pivots the control disc 48 into the position shown in FIG. 6*a* by means of the control lever 50 contacting thereagainst. In this position, the arresting bolt 44 occupies the position illustrated in FIGS. 3 and 5 and thus arrests the centering device 34 on one rod 37 in the uppermost position. The introduction of the pressurized gas into the bottle 11, and the subsequent filling of the bottle 11, are effected by control of the pressurized gas valve arrangement. The filling element 23, with the filled bottle, then moves past the control element 53, which by means of the control lever 50 again pivots the control disc 48 into the starting position according to FIG. 6*b*, whereby the arresting bolt 44 is withdrawn or retracted from the arresting recess 45 of the rod 37. As soon as the roller 28 of the bottle plate 25 engages the incline of the cam 29, the filled bottle 11 is lowered, in which connection the centering device 34 supported against the bottle mouth or opening likewise moves downwardly. This transition occurs between the filling element shown at the right and in the center in FIG. 1. In so doing, the control roller 40 of the centering device 34 runs over the upwardly extending section 42 of the cam 41, as a result of which the centering device 34 is lifted for releasing the bottle 11 which has been filled and is to be discharged, as indicated with the central bottle filling element in FIG. 1.

If bottle breakage occurs during operation, the centering device 34 is held in the upper position by arresting one of its rods 37 until the corresponding filling element has reached the control element 53. The arresting is then cancelled or eliminated by this control element 53 as described previously.

In the event an interruption in the feeding or supplying of the bottles 11 to be filled should occur, i.e. if empty places occur in the star 15, this is detected by the light barrier 57, and the control device 56 is actuated, which brings the control element 52 into the effective condition or position. Consequently, the centering device 34 is arrested in the partially lifted position determined by the cam 41, as described in connection with FIG. 4. Since the control element 52, by means of the control lever 50, pivots the control disc 48 in the same direction as does the control element 51, no further adjustment can occur any more on the control element 51. The arresting device 43 accordingly remains engaged, and the centering device 34 remains in the partially lifted position, until the respective filling element 23, after passing the ineffective or inoperative control element 53, reaches the control element 74. By pivoting the control disc 48 again into the starting position according to FIG. 6*b*, the arresting bolt 44 is withdrawn or retracted from the arresting recess 46 of the rod 37, and the centering device 34 is released.

FIG. 7 shows a modification of the arresting device in that the arresting bolt 44*a* is rotatably journalled in the housing of the arresting device 43*a*. The spring 47*a* serves in this case only for definite engagement of the arresting bolt 44*a* against an axial slide surface. The arresting bolt 44*a* in this example extends laterally through the guide bore 38*a* of one of the rods 37*a*, and is embodied with a lateral recess 44*b* in this overlapping or intersecting region. The free end of the rotatable arresting bolt 44*a* extends out of the housing of the arresting device 43*a*, and at this location directly supports the control lever 50*a*. The arresting bolt 44*a* is pivoted with this control lever 50*a*, by the control elements 51 and 52, into the arresting position, while the control elements 53 and 74 are designed to pivot the control lever 50*a*, and with it the arresting bolt 44*a*, back into the release position. Otherwise, the manner of operation of this device is identical to that according to FIGS. 1–6. In addition, a positive connection can be provided for increasing the operational reliability by a torsion spring built into the arresting bolt 44*a*, so that during pivoting of the control lever 50*a* no break or interruption occurs at any part of the arresting device 43*a* when the arresting bolt 44*a* is located opposite a full part, i.e. is not opposite one of the recesses 45*a* and 46*a*, of the rod 37*a*.

The inventive arresting device of the example of FIGS. 8–10 is combined with a valve and control device into a unit 60, as more clearly apparent from FIG. 9. This valve-, control- and arresting unit 60 includes a valve disc 61, which is provided with bores and transverse channels in order, in the position (FIG. 10*b*), to connect a pressurized gas supply conduit 62 with a pressurized gas inlet conduit 63 which leads to the interior of the placed-on bottle along the outer side of the filling tube 33. In the pressure equalizing position, the pressurized gas inlet conduit 63 is connected by means of the valve disc 61 with a pressure equalizing conduit 64 which leads to the interior of the filling tube 33. Finally, in the filling position of the valve disc 61 (FIG. 10*a*), the connection between the pressurized gas supply conduit 62, the pressurized gas inlet conduit 63, and the pressure equalizing conduit 64 is eliminated. As shown in FIG. 9, this valve disc 61 is installed or attached on a valve-disc carrier or support 48*a*, the rear side of which is provided with a cam surface 54*a* upon which a follower roller 55 installed on the control bolt 44 runs in the same manner as in the example of FIGS. 1–6. The arresting bolt 44 is continuously under the influence of the press spring 47, which strives to move the arresting bolt 44 axially toward the rod 37 of the centering device 34. The position of the arresting bolt 44 relative to the rod 37 is dictated by the cam surface 54*a*, as with the example of FIGS. 1–6.

Just like the example of FIGS. 1–6, the valve disc carrier 48*a*, which acts as a control disc, is embodied with a shaft 49 which supports a control lever 50 on the outer side thereof. This control lever 50 consequently serves simultaneously for actuation of the valve disc 61, and for control of the arresting bolt 44 of the arresting device 43 included in the valve-, control-, and arresting unit 60. The filling element according to FIGS. 8–10 is additionally equipped with an electrical control switch 65 which, together with an electrical control member 66 installed on the filling tube 33, serves by means of a control device 70 to control an electromagnetic closure actuating device 67 for the liquid flow valve 68 and the electromagnetic actuating device for the pressurized gas outlet valve 69. The electrical control switch 65, as shown particularly in FIG. 10, is controlled by a cam surface 71, provided on the peripheral surface of the valve disc carrier 48*a*, in connection with a feeler or sensing element 72 and a spring 73. The control of this electrical switch 65 accordingly occurs simultaneously with the adjustment of the valve disc 61 and the control of the arresting bolt 44. This combined control is apparent from FIG. 10 as follows.

The discharging of liquid from the filling tube occurs in the pressure equalizing position illustrated in FIG. 10*c* by connecting the pressure equalizing conduit 64 with the pressurized gas inlet conduit 63. The follower roller 55 concurrently engages an elevated part of the cam surface 54*a*. The control switch 65 is open. However, the electromagnetic control 67 for the liquid flow valve 68 is switched on because the corresponding control current circuit is closed by the liquid contact of the control member 66 on the filling tube 33. The pressure equalizing position illustrated in FIG. 10*c* is simultaneously the starting position for switching into the pressurizing position, and corresponds to a position of the respective filling element 23 after the latter has passed by the control element 53 or 74 illustrated in FIG. 2.

If the control lever 50 of the control-, valve-, and arresting unit 60 is brought into the pressurizing position represented in FIG. 10*b* with the passing of the respective filling element 23 by the control element 51 or the additional control element 52, which is kept in the effective position, then a connection is established on the valve disc 61 between the pressurized gas supply conduit 62 and the pressurized gas inlet conduit 63, so that pressurized gas is introduced into the placed-on bottle. Simultaneously, a recessed part of the cam surface 54*a* is rotated below the feeler roller 55, so that the inner end of the arresting bolt 44, by the effect of the spring 47, is pushed into the the oppositely located arresting recess 45 of the rod 37. Additionally, in this pressurizing position according to FIG. 10*b*, the control switch 65 is closed by engagement of the filler 72 with the circumferential cam surface 71, so that the electromagnetic closure control 67 of the liquid flow valve 68 is switched-on and an opening of the liquid flow valve 68 is prevented. In addition to the embodiments according to FIGS. 1–7, a further control element is installed on the machine frame in the example according to FIGS. 8–10, and in particular in that region in which the filling of a placed-on bottle with liquid occurs. By means of this further (non-illustrated) control element, the valve disc 61 and the valve disc carrier 48*a* are pivoted into the filling position reproduced in FIG. 10*a*. In this filling position, the control switch 65 is opened by the feeler pin 72 running free from the cam surface 71, and also the control member 66 installed on the filling tube 33 is still free of liquid. The electromagnetic closure control 67 for the liquid flow valve 68 is thereby switched-off, so that the liquid flow valve 68 opens.

Under these circumstances the valve disc 61 has interrupted every connection between the pressurized gas supply conduit 62, the pressurized gas inlet conduit 63, and the pressure equalizing passage 64, so that with the flowing-in of the liquid, the pressurized gas can now only discharge by way of the outlet conduits, and the nozzles included therein, illustrated in FIG. 8, whereby the narrower nozzle illustrated in FIG. 8 leads to a continuously open channel, and the further nozzle leads to the pressurized gas outlet valve 69. The pressurized gas outlet valve 69 is opened in a controlled manner during the supplying of the liquid. However, the electrical control associated therewith is not within the purview of the teaching of the present invention.

In the following position illustrated in FIG. 10*a*, the pick-up or follower roller 55 of the arresting pin 44 is still in a recessed part of the cam surface 54*a*, so that the arresting bolt 44 still engages the arresting recess 45 of the rod 37. The withdrawal of the arresting bolt 44 from the arresting recess 45 of the rod 37 does not occur until the respective filling element reaches the control element 53 illustrated in FIG. 2 during circulation of the machine, and consequently the valve disc and the valve disc carrier are rotated by means of the control lever 50 into the pressure relief position shown in FIG. 10*c*.

Moreover, the manner of operation of the filling machine is identical to that of FIGS. 1–6. This is especially true with respect to the manner of operation of the control elements 52, 53, and 74 upon bottle breakage, missing bottles, and interrupted bottle supply, and the possibility of providing two arresting recesses 45 and 46 in the rod 37.

The mechanical actuation set forth in the foregoing embodiments by means of the control lever 50 or 50*a* can also be replaced by pneumatic, hydraulic, or electrical actuation of the arresting device 43,43*a*, or of the valve-, control-, and arresting unit 60. The electrical actuation is recommended when the filling machine is equipped with electrical cycle control.

The present invention is, of course, in no way restricted to the specific disclosure of the specification and drawings, but also encompasses any modifications within the scope of the appended claims.

What I claim is:

1. A rotating single or multi-chamber counterpressure filling machine in combination comprising a plurality of filling elements, each of which is provided with:

a controlled pressurized gas valve arrangement having a valve unit and a control unit;

a centering device which includes a centering tulip supported by guided rods which are movable up and down, each centering device being individually controllable for holding and also for releasing operation therewith during circulation of the filling machine; and a controllable arresting device for arresting said centering device in an upper position, and for releasing same, said arresting device effecting arresting of said centering device by engaging at least one of said rods thereof, at least one of said rods of said centering device being provided with at least one arresting recess, and in which said arresting device includes an arresting bolt which is mounted so as to be axially displaceable in said arresting device, and which is movable in and out of said at least one arresting recess in a controlled manner, said arresting device and said valve unit and control unit of said pressurized gas valve arrangement forming a structural unit, said arresting device being controllable in common with said pressurized gas valve arrangement, said valve unit and control unit of said pressurized gas valve arrangement including: a valve disc which is provided with openings and connecting conduits, and is rotatable into desired operating positions; and at least one control cam for actuating said arresting bolt.

2. A counterpressure filling machine according to claim 1, in which said valve unit and said control unit of said pressurized gas valve arrangement further include an essentially disc-shaped valve-disc carrier for supporting said valve disc; and in which a surface of at least one of said valve disc and said valve-disc carrier are provided with at least one cam surface to form said at least one control cam.

3. A counterpressure filling machine according to claim 2, in which said arresting device is arranged in said valve unit and control unit; said arresting bolt is axially parallel to said valve disc and is axially retractable against spring force; and said cam surface, which controls said arresting bolt, is arranged on a substantially radially extending surface of one of said valve disc and said valve-disc carrier.

4. A counterpressure filling machine according to claim 3, which comprises a frame; a rotating portion operatively associated with said frame, said filling elements being mounted to said rotating portion; and means arranged on said frame for lifting a respective centering device to allow introduction of a container to be filled into said machine; and in which at least one of said rods of said centering device is provided with at least one further arresting recess located above said earlier recited arresting recess.

5. A counterpressure filling machine according to claim 4, which includes: a control element arranged on said machine frame in the container-inlet region of said machine; a control device; and an element which monitors the introduction of containers to be filled into said machine, said control element being connected to said monitoring element by means of said control device for placing said control element into an inoperative condition upon introduction into said machine of a container to be filled, and into an operative condition when such a container is absent.

* * * * *